US009737781B2

(12) United States Patent
Pelz

(10) Patent No.: US 9,737,781 B2
(45) Date of Patent: Aug. 22, 2017

(54) SYNTHETIC PUTTING GREEN

(71) Applicant: David T Pelz, Austin, TX (US)

(72) Inventor: David T Pelz, Austin, TX (US)

( * ) Notice: Subject to any disclaimer, the term of this patent is extended or adjusted under 35 U.S.C. 154(b) by 0 days.

(21) Appl. No.: 13/927,610

(22) Filed: Jun. 26, 2013

(65) Prior Publication Data

US 2013/0344975 A1 Dec. 26, 2013

Related U.S. Application Data

(60) Provisional application No. 61/664,412, filed on Jun. 26, 2012.

(51) Int. Cl.
*A63B 69/36* (2006.01)

(52) U.S. Cl.
CPC ..... *A63B 69/3661* (2013.01)

(58) Field of Classification Search
USPC ..... 473/171, 173, 157, 150, 159, 160, 161, 473/169, 278, 497; 428/306.6, 308.4, 442
See application file for complete search history.

(56) References Cited

U.S. PATENT DOCUMENTS

| | | | | |
|---|---|---|---|---|
| 2,515,847 A | | 7/1950 | Winkler | |
| 3,418,897 A | | 12/1968 | Humalainen | |
| 3,661,687 A | * | 5/1972 | Spinney et al. | 428/17 |
| 3,740,303 A | * | 6/1973 | Alderson et al. | 428/17 |
| 3,900,656 A | * | 8/1975 | Schmidt | 428/215 |
| 4,337,283 A | * | 6/1982 | Haas, Jr. | 428/17 |
| 4,812,339 A | | 3/1989 | Shibata et al. | |
| 4,957,798 A | * | 9/1990 | Bogdany | 428/95 |
| 6,161,776 A | * | 12/2000 | Byles | 239/145 |
| 6,221,445 B1 | | 4/2001 | Jones | |
| 6,508,719 B1 | | 1/2003 | Reddick | |
| 6,616,542 B1 | | 9/2003 | Reddick | |
| 7,736,241 B2 | * | 6/2010 | Lancia | 473/171 |
| 2009/0011845 A1 | | 1/2009 | Weber et al. | |

OTHER PUBLICATIONS

Jerri Farris, Black & Decker the Complete Guide to DIY Projects for Luxurious Living Adding Style & Elegance with Showcase Features You Can Build, 2008, Creative Publishing International, pp. 221-225.*

(Continued)

*Primary Examiner* — Gene Kim
*Assistant Examiner* — Jeffrey Vanderveen
(74) *Attorney, Agent, or Firm* — Cesari & Reed, LLP; R. Michael Reed

(57) ABSTRACT

A synthetic putting green includes a crown, skirt and trough. The putting green includes a support surface shaped to define a crown, a skirt circumferentially positioned about the crown and a trough circumferentially positioned about the skirt. Landscape edging is applied to the support surface about a perimeter of the crown so as to define an interior space functioning as a putting surface. A containment layer is applied upon the support surface within the interior space and an open cell foam material applied over the containment layer within the interior space. A layer of synthetic turf is then applied to cover the containment layer and the open cell foam material within the interior space. A method for making the synthetic putting green is also disclosed.

16 Claims, 11 Drawing Sheets

(56) References Cited

OTHER PUBLICATIONS

Max, How to Make a DIY Backyard Putting Green!, Jun. 11, 2011, http://progolferdigest.com/short-game/putting/how-to-make-a-diy-backyard-putting-green/#.*
Energsmart, Copyrighted 2009-2014, http://www.fomo.com/open-cell-versus-closed-cell.aspx.*
John Bartlo, Open vs. Closed Cell Foam, Jun. 21, 2011, http://www.energsmart.com/spray-foam-insulation/open-vs-closed-cell-foam.html.*

* cited by examiner

SYNTHETIC PUTTING GREEN

CROSS REFERENCE TO RELATED APPLICATION

The present application claims the benefit of U.S. Provisional Patent Application Ser. No. 61/664,412, entitled "SYNTHETIC PUTTING GREEN," filed Jun. 26, 2012.

BACKGROUND OF THE INVENTION

1. Field of the Invention

The present invention relates to a putting green and a method for forming the putting green. More particularly, the invention relates to a synthetic putting green providing a surface that reacts to golf balls just like a traditional grass putting green.

2. Description of the Related Art

Maintenance costs associated with golf practice facilities are very high. While practice facilities have attempted to confront this problem with the use of synthetic low maintenance materials, the synthetic materials often do not replicate the characteristics of traditional sand, dirt and grass. As such, a need exists for a low maintenance practice facility without sacrificing the traditional feel and characteristics of putting greens.

SUMMARY OF THE INVENTION

It is, therefore, an object of the present invention to provide a synthetic putting green including a crown, skirt and trough. The putting green includes a support surface shaped to define a crown, a skirt circumferentially positioned about the crown and a trough circumferentially positioned about the skirt. Landscape edging is applied to the support surface about a perimeter of the crown so as to define an interior space functioning as a putting surface. A containment layer is applied upon the support surface within the interior space and an open cell foam material applied over the containment layer within the interior space. A layer of synthetic turf is then applied to cover the containment layer and the open cell foam material within the interior space.

It is also an object of the present invention to provide a synthetic putting green wherein the trough includes an outer boundary.

It is another object of the present invention to provide a synthetic putting green wherein the support surface includes an underlying support surface, a secondary support surface layer and a weed barrier cloth positioned between the underlying support surface and the secondary support surface layer.

It is a further object of the present invention to provide a synthetic putting green wherein the secondary support surface layer is composed of dirt, gravel, decomposed granite or clay.

It is also an object of the present invention to provide a synthetic putting green wherein a contact surface of the putting green is slightly raised from a base supporting structure so as to define a relatively planar top surface with the skirt downwardly tapering between the crown and the base supporting structure.

It is another object of the present invention to provide a synthetic putting green wherein the containment layer is made from a nonwoven protective material.

It is a further object of the present invention to provide, a synthetic putting green wherein the open cell foam material is a coarse filter material.

It is also an object of the present invention to provide a synthetic putting green wherein the open cell foam material has a thickness between approximately 0.75 inch to approximately 1.25 inches.

It is another object of the present invention to provide a synthetic putting green wherein the open cell foam material is impregnated with a sand/rubber blend.

It is a further object of the present invention to provide a synthetic putting green wherein the sand/rubber blend is composed of approximately 15% rubber particles and 85% general purpose sand.

It is also an object of the present invention to provide a method for constructing a synthetic putting green including a crown, skirt and trough. The method includes the steps of creating a support surface by grading a base supporting structure, applying landscape edging on the support surface so as to define an interior space which is shaped and dimensioned as a putting surface on the crown of the putting green, filling the skirt and trough with fill dirt such that the fill dirt substantially surrounds the landscape edging and rises to a level even with an upper edge of the landscape edging, applying a containment layer to the support surface within the interior space, applying open cell foam material to an upper surface of the containment layer, and applying a layer of synthetic turf over the open cell foam material and the skirt.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
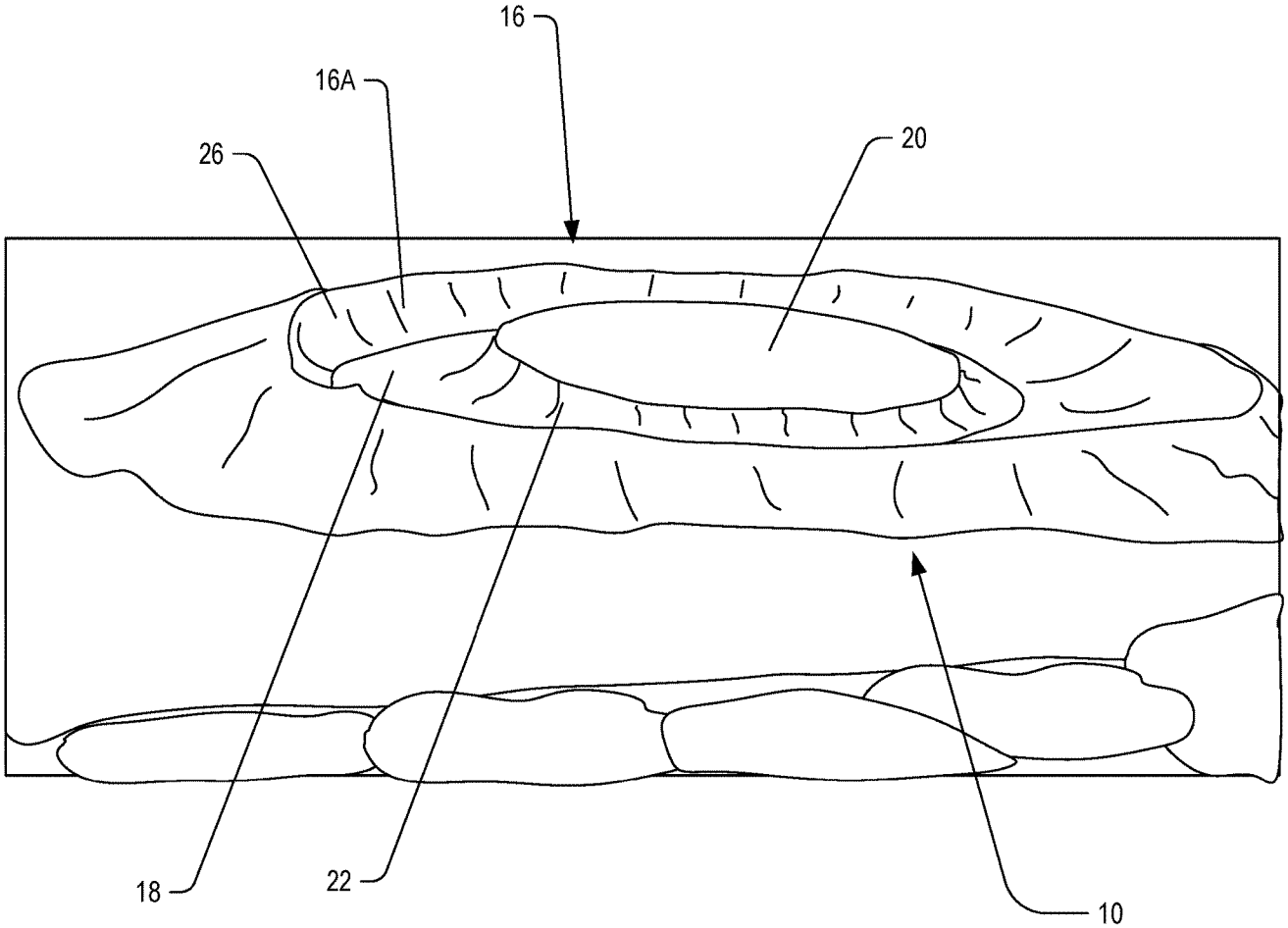
FIGS. 1 to 10 disclose the various steps in the fabrication of a synthetic putting green in accordance with the present invention.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

With regard to FIGS. 1-11, a synthetic putting green 10 and a method for forming the putting green 10 are disclosed. The putting green 10 of the present invention is designed for practicing approach shots and offers impact and roll characteristics similar to those of a traditional putting green. The putting green 10 in accordance with the present invention is synthetic but provides a contact surface 12 that reacts to golf balls 14 in the same manner as a traditional grass putting green. That is, the present putting green 10 provides bounce and roll after impact of a golf ball 14 with the putting green similar to that encountered when hitting golf balls into a traditional grass putting green.

Briefly, and as will be appreciated based upon the following disclosure, the synthetic putting green 10 is oriented to replicate a traditional putting green and, therefore, includes a crown 20, a skirt 22 and a trough 18. It will be appreciated these terms are used throughout the present disclosure to refer to various sections of the putting green during both the final putting green and the putting green at various points in time during the assembly thereof.

The putting green 10 includes a support surface 16 shaped to define the underlying groundwork for the final shape of the central crown 20, the skirt 22 circumferentially positioned about the crown 20 and the trough 18 circumferentially positioned about the skirt 22. Landscape edging 28 is applied to the support surface in a position defining the perimeter of the crown 20. As such, the landscape edging 28 defines an interior space 35 that ultimately defines the putting surface formed on the crown 20 of the putting green 10. A containment layer 34 is applied upon the support surface 16 within the interior space 35. An open cell foam material 36 is applied over the containment layer 34 within the interior space 35. A layer of synthetic turf 44 is applied over the containment layer 34 and open cell foam material 36 within the interior space 35 so as to cover the containment layer 34 and open cell foam material 36 within the interior space 35.

With reference to the various figures, and as will be explained below in greater detail, such a putting green 10 is, therefore, constructed by first creating the support surface 16. The support surface 16 is preferably formed by applying dirt and thereby grading the base supporting structure 18, which ultimately forms the trough 18 of the final putting green 10 upon completion of the grading process (and is therefore referenced with the same reference numeral). Thereafter, landscape edging 28 is applied to the support surface 16 so as to define the perimeter of the crown 20. The skirt 22 is filled with dirt such that the fill dirt 30 substantially surrounds the landscape edging 28 and rises to a level even with the upper edge 32 of the landscape edging 28. A containment layer 34 is applied to the support surface 16 in the area, that is, the interior space 35, defined by the landscape edging 28 and open cell foam material 36 is applied to the upper surface 38 of the containment layer 34. The open cell foam material 36 is impregnated with a sand/rubber blend 46 and a layer of synthetic turf 44 is applied to the open cell foam material (that is, over the crown 20) and along the downwardly sloping edges defining the skirt 22.

As described below, the putting green 10 ultimately includes a crown or top surface 20, a circumferential border or skirt 22 surrounding the crown 20, and a trough or base supporting structure 18 positioned about the circumferential border or skirt 22. As such, the crown 20 defines the traditional central putting surface forming the desired target for incoming golf shots. The circumferential border or skirt 22 may be thought of as the fringe surrounding a traditional putting green, which commonly has a downward slope such that halls striking the circumferential border or skirt 22 roll away from the putting surface. The trough 18 replicates the rough or sand traps surrounding the circumferential border or skirt 22.

Figure 11:
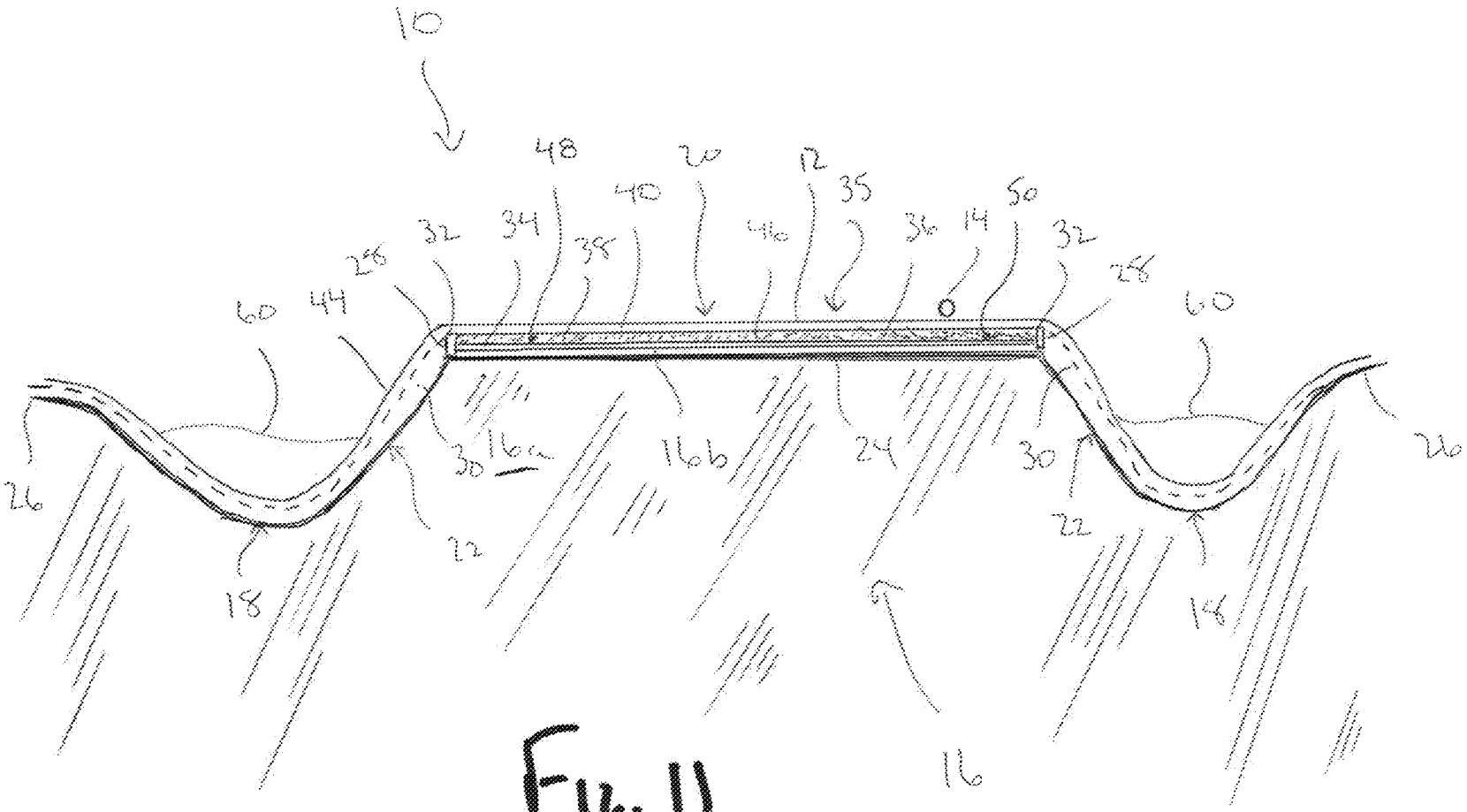
FIG. 11 is a cross sectional schematic of the present synthetic putting green.

As will be appreciated based upon the following disclosure, and with particular reference to FIG. 11, the putting green 10 includes a support surface 16 built upon the base supporting structure 18. The support surface 16, due to its upwardly sloping shape extending from the base supporting structure 18, ultimately dictates the shape and location of the crown 20, skirt 22 and trough 18 of the resulting putting green 10. In particular, the support surface 16 includes an underlying support surface 16*a*, a secondary support layer 16*b* positioned above the underlying support surface 16*a*, and weed barrier cloth 24 positioned therebetween. The underlying support surface 16*a* is preferably shaped with an upward slope extending upward from the base supporting structure 18 and defines the resulting shapes of the crown or top surface 20, the circumferential border or skirt 22, and the trough or base supporting structure 18, as well as an outer boundary 26 of the trough 18. A weed barrier cloth 24 is positioned over the underlying support surface 16*a*. The weed barrier cloth 24 is then covered with a secondary support surface layer 16*b*.

Landscape edging 28 is positioned on the support surface 16 in the area of the crown or top surface 20 of the putting green 10. The space defined by the landscape edging 28 defines the crown or top surface 20 of the putting green 10, that is, the traditional putting surface at which golfers aim their incoming shots. As such, the landscape edging 28 is mounted upon the support surface 16 so as to form a complete, continuous boundary for that portion of the support surface 16 that will define the putting surface at which golfers aim incoming shots.

The crown 20, in particular, the interior space 35 defined by the landscape edging 28, is then covered with a containment layer 34 and an open cell foam material 36. A sand/rubber blend is applied to the open cell foam material so as to fill in the open cells of the foam. Finally, a layer of synthetic turf 44 is applied over the crown 20 and along the downwardly sloping edges 22 thereof to complete the putting green.

With reference to FIG. 1, the general contour of the putting green 10 is first established by creating a support surface 16. The support surface 16 is first established by grading the base supporting structure 18 with an underlying support surface 16*a* composed of an initial layer of dirt, gravel, decomposed granite and/or clay. Once the underlying support surface 16*a* of the putting green 10 is formed with this initial layer of dirt, gravel, decomposed granite and/or clay, the ground is tamped and a weed barrier cloth 24 is applied (see FIG. 2). In accordance with a preferred embodiment, a commercially available heavy-duty weed barrier is used. Since the weed barrier will ultimately be positioned beneath a secondary support surface layer 16*b* of dirt, gravel, decomposed granite and/or clay, as well as the other layers of the present putting green as described below, the weed barrier does not make a difference in the green, but simply protects against most growth from beneath. The weed barrier cloth 24 is applied to the entire initial layer of the underlying support surface 16*a* including the crown or top surface 20, the circumferential border or skirt 22, and the trough or base supporting structure 18, as well as the outer boundary 26 of the trough 18.

Figure 2:
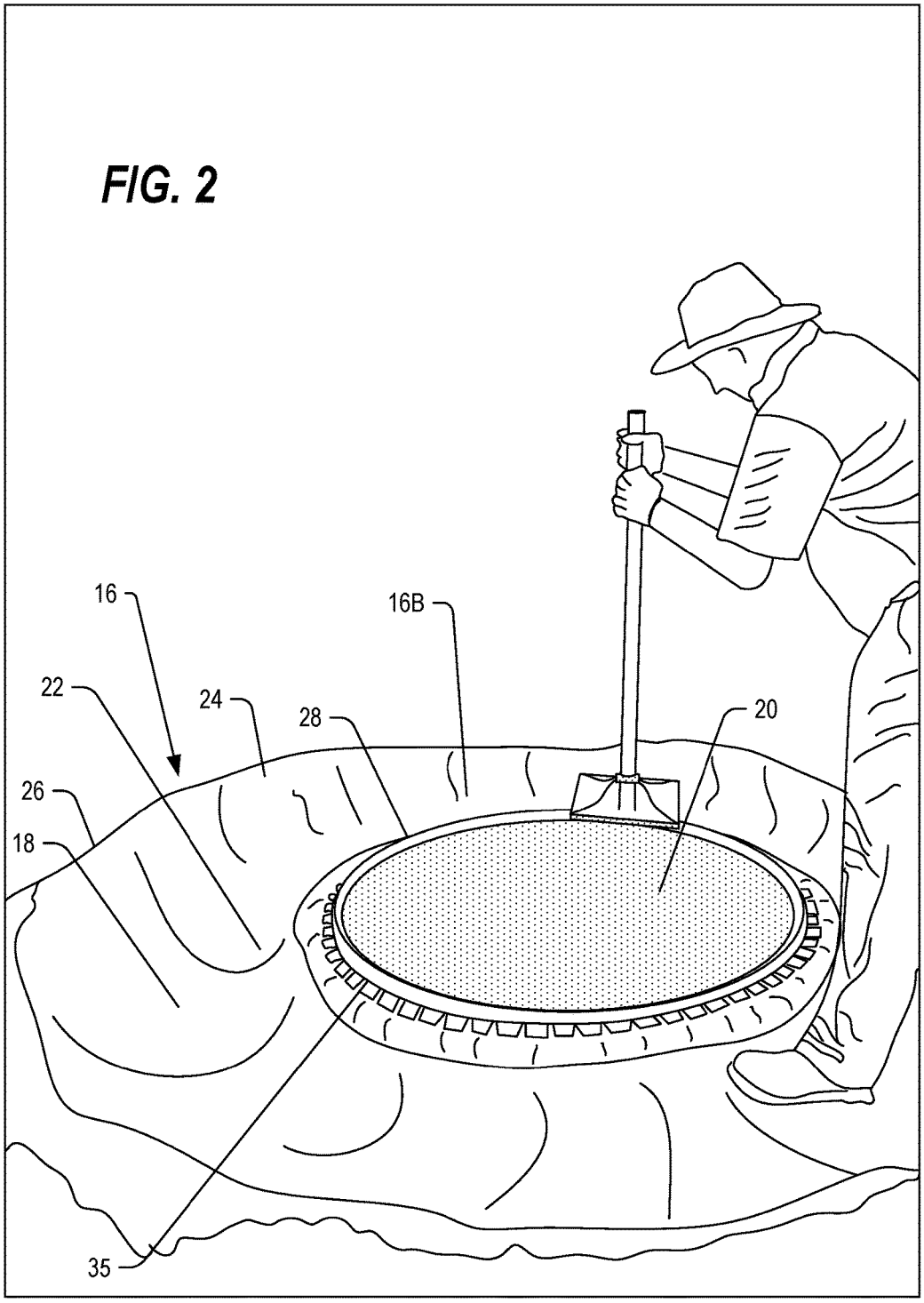
Figure 3:
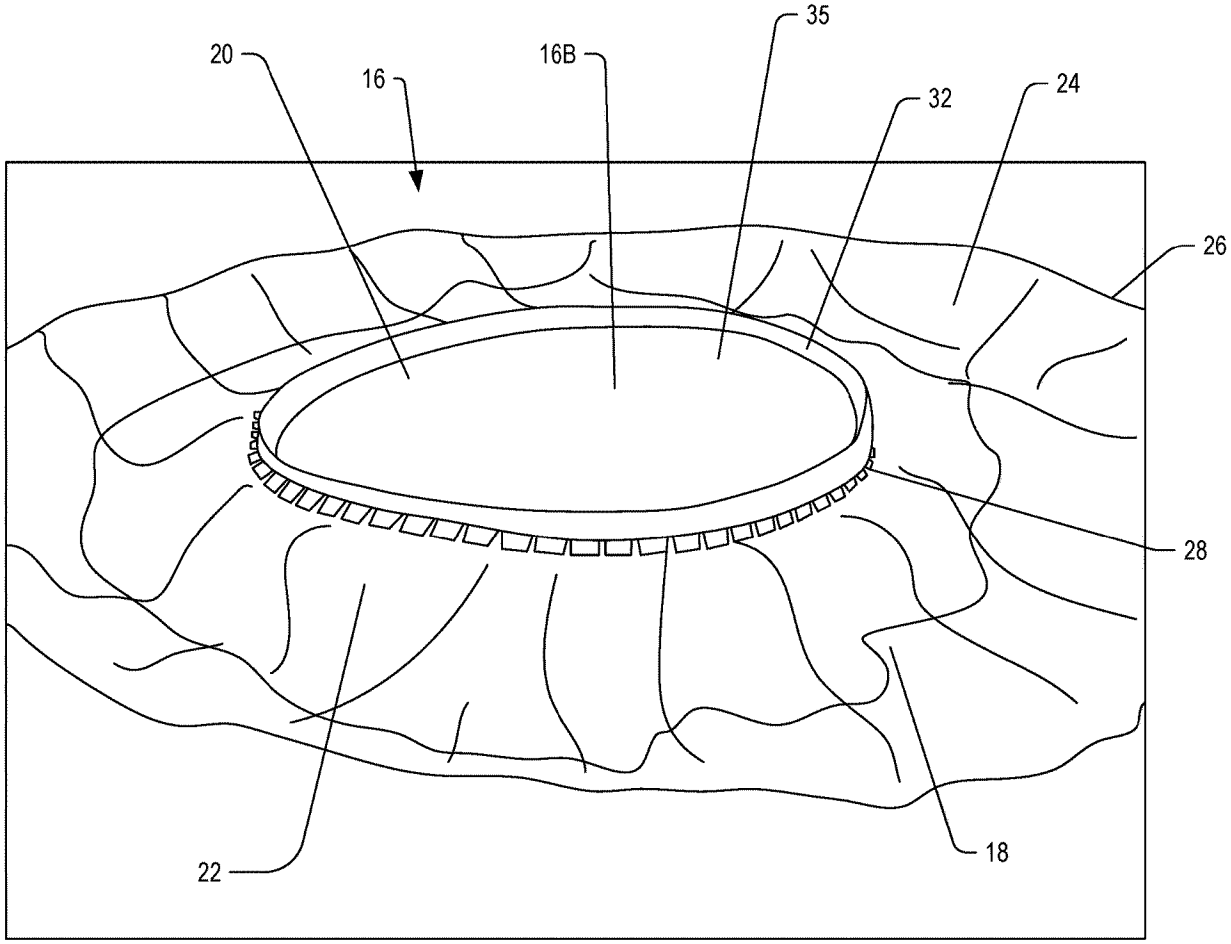

Thereafter, and referring to FIGS. 2 and 3, the support surface 16 is finalized with the application of a secondary support surface layer 16*b* of dirt, gravel, decomposed granite and/or clay. The dirt, gravel, decomposed granite and/or clay is then graded to a desired surface configuration so as to establish the surface contour of the final putting green. In accordance with a preferred embodiment, the contact surface 12 of the putting green 10 is slightly raised from the base supporting structure 18 so as to define the relatively planar top surface 20 with downwardly tapering edges or skirt 22 extending between the planar top surface 20 and the base supporting structure 18. It is appreciated, that although a "relatively planar" top surface is disclosed herein in accordance with a preferred embodiment, the top surface may have contours similar to those found on traditional putting greens. As a result of the contouring described above, the support surface 16 of the putting green 10 resembles a crowned surface with a central raised surface circumferentially oriented, downwardly tapered surfaces and a lower surrounding trough.

Figure 8:
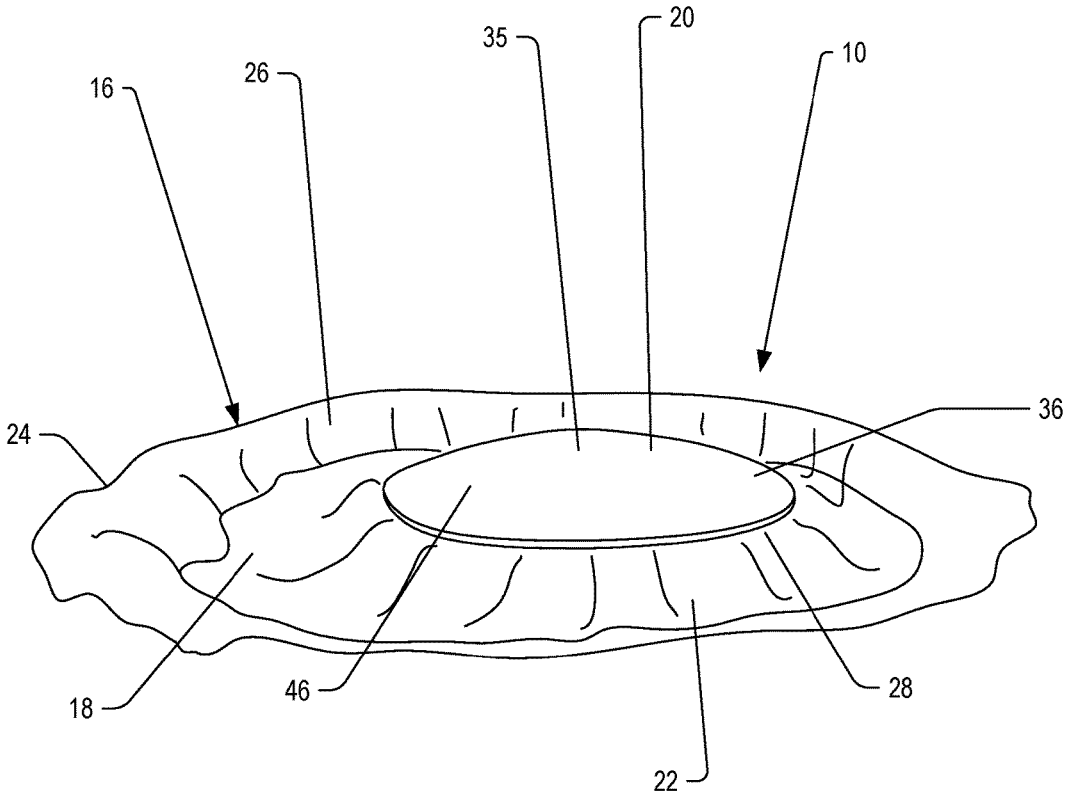

As shown in FIGS. 2 and 3, landscape edging 28 is then applied about the perimeter of the crown 20. It is appreciated the landscape edging is conventional edging material, for example, OLY-OLA STONE-EDG paver restraints manufactured by Oly-Ola Edging Inc. It is also appreciated other edging materials may be used. The landscape edging 28 preferably includes a height of approximately 1 (one) inch when applied about the perimeter of the crown 20 of the putting green 10 as shown in FIGS. 2 and 3. Once the landscape edging 28 is applied, the skirt 22 and trough 18 of the putting green 10 are filled in with fill dirt 30 such that the fill dirt 30 substantially surrounds the landscape edging 28 and rises to a level even with the upper edge 32 of the landscape edging 28 (see FIGS. 3 and 5). The fill dirt is then tamped. As shown in FIG. 8, the fill dirt 30 may be added at various times during the construction process.

Figure 4:
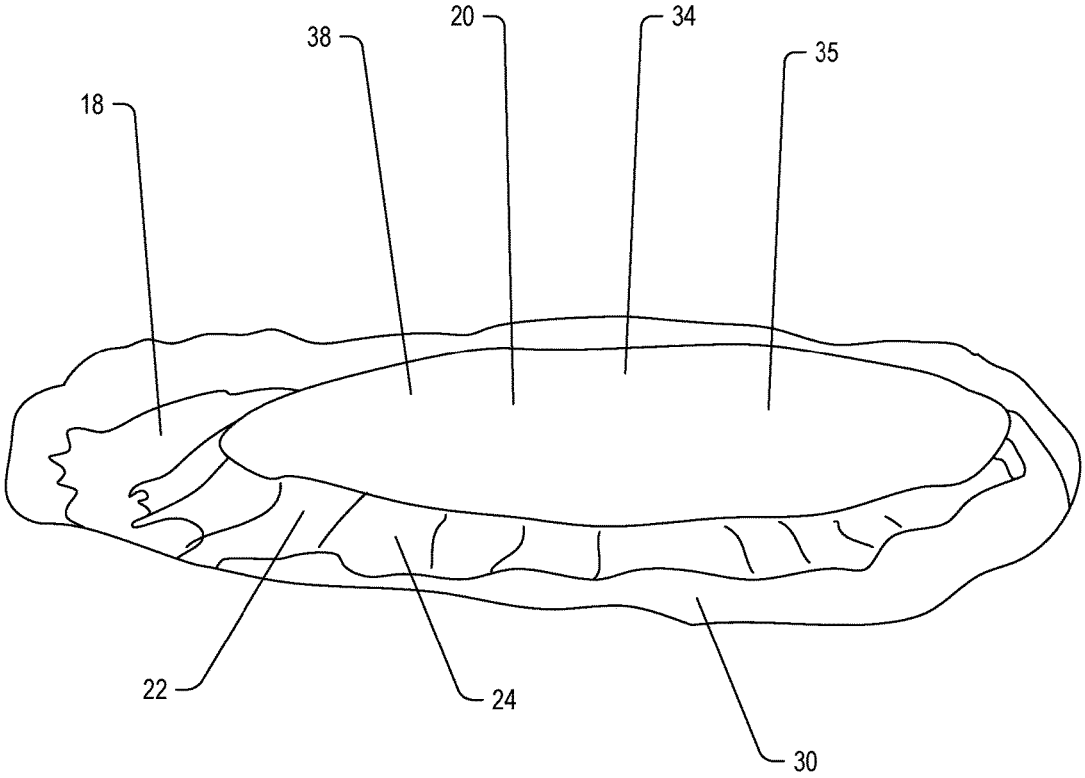
Figure 5:
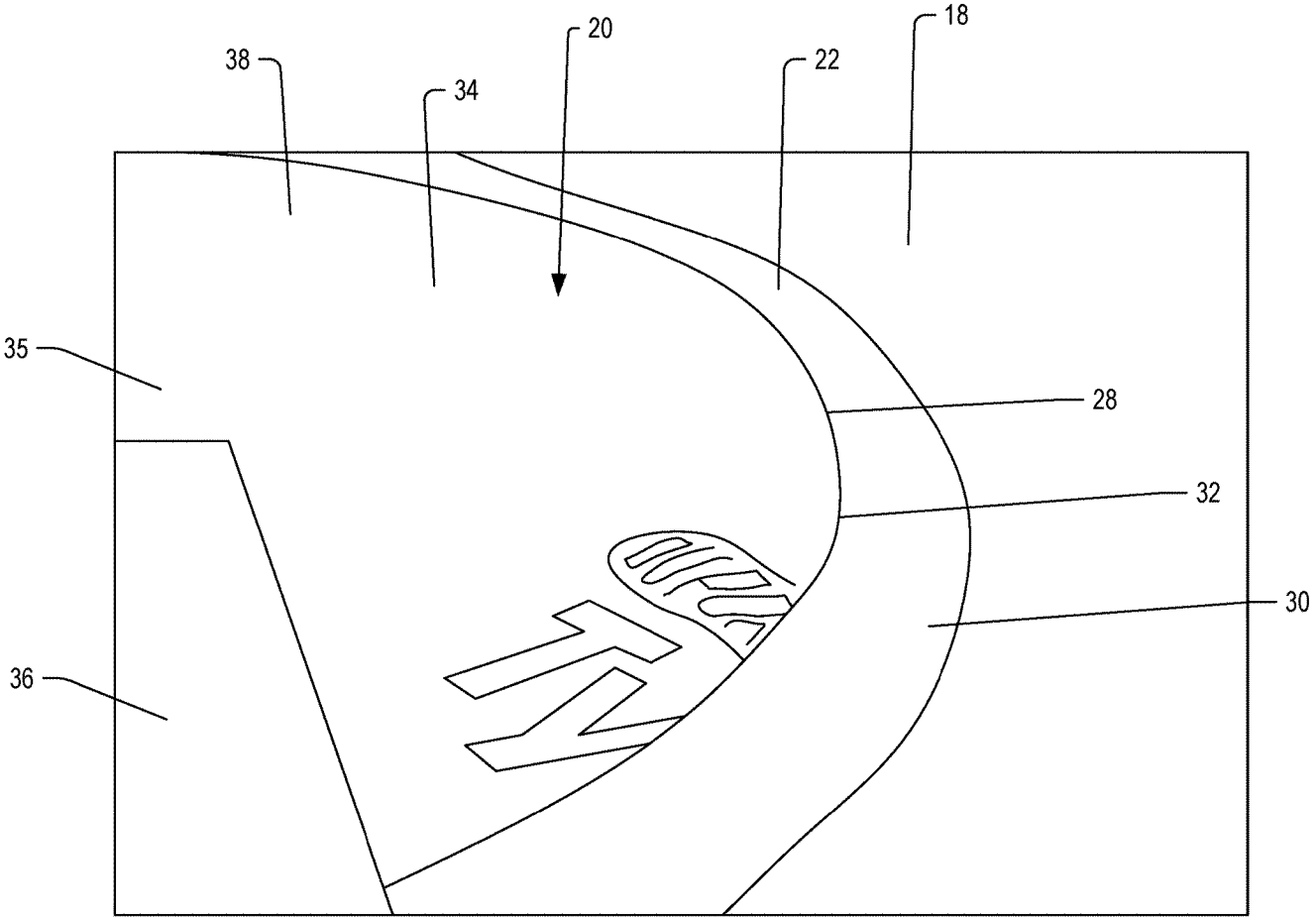

Referring to FIGS. 4 and 5, a containment layer 34 is applied to the surface of the crown 20. The containment layer functions to maintain the layers applied thereto above the underlayers by preventing downward penetration of the sand/rubber blend 46 discussed below in greater detail. In particular, the containment layer is made from TYVEK® (a nonwoven protective material manufactured by DuPont) and is applied to the crown 20 within the interior space 35 defined by the landscape edging 28. The interior space 35 is the area that will ultimately constitute the putting contact surface 12 of the finished putting green 10.

Figure 6:
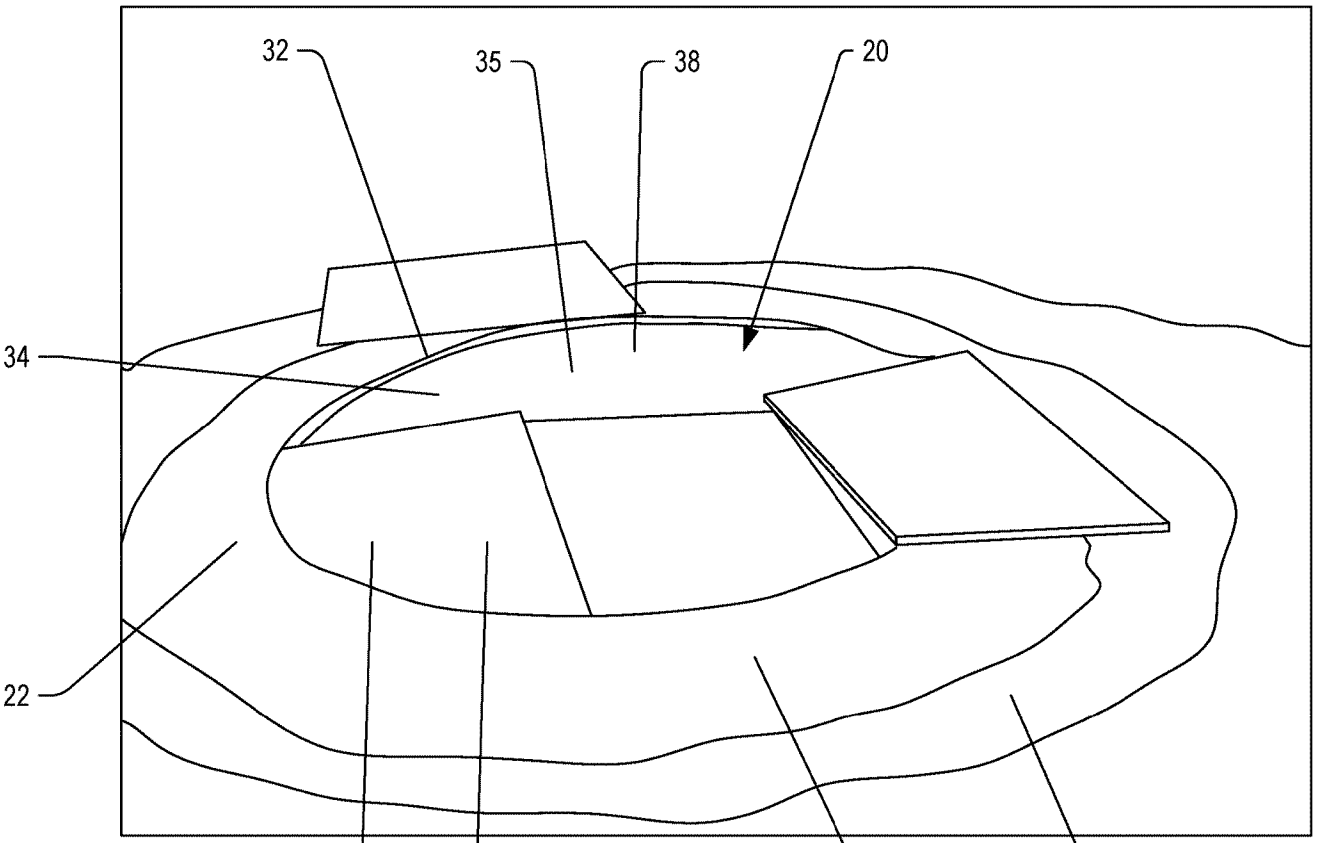

Referring to FIG. 6, open cell foam material 36 is then applied to the upper surface 38 of the containment layer 34. In accordance with a preferred embodiment, the open cell foam material 36 is a coarse filter material manufactured by Dott Products. It is appreciated the open cell foam material preferably has a thickness between approximately 0.75 inch to approximately 1.25 inches, more preferably a thickness of approximately 1 (one) inch. Ultimately, the foam material 36 has a pore size large enough to permit penetration by the sand and rubber of the sand/rubber blend 46. The foam material 36 also exhibits sufficient tensile strength, or lateral mesh strength, to contain the sand/rubber blend 46 and prevent the sand/rubber blend 46 from migrating laterally. The foam material 36 is applied to completely cover the containment layer 34. The foam material 36 is applied such that its upper surface 40 is substantially flush with the upper edge 32 of the landscape edging 28. In this way, a substantially smooth surface is created when the artificial or synthetic turf 44 is applied as described below in greater detail.

Figure 7:
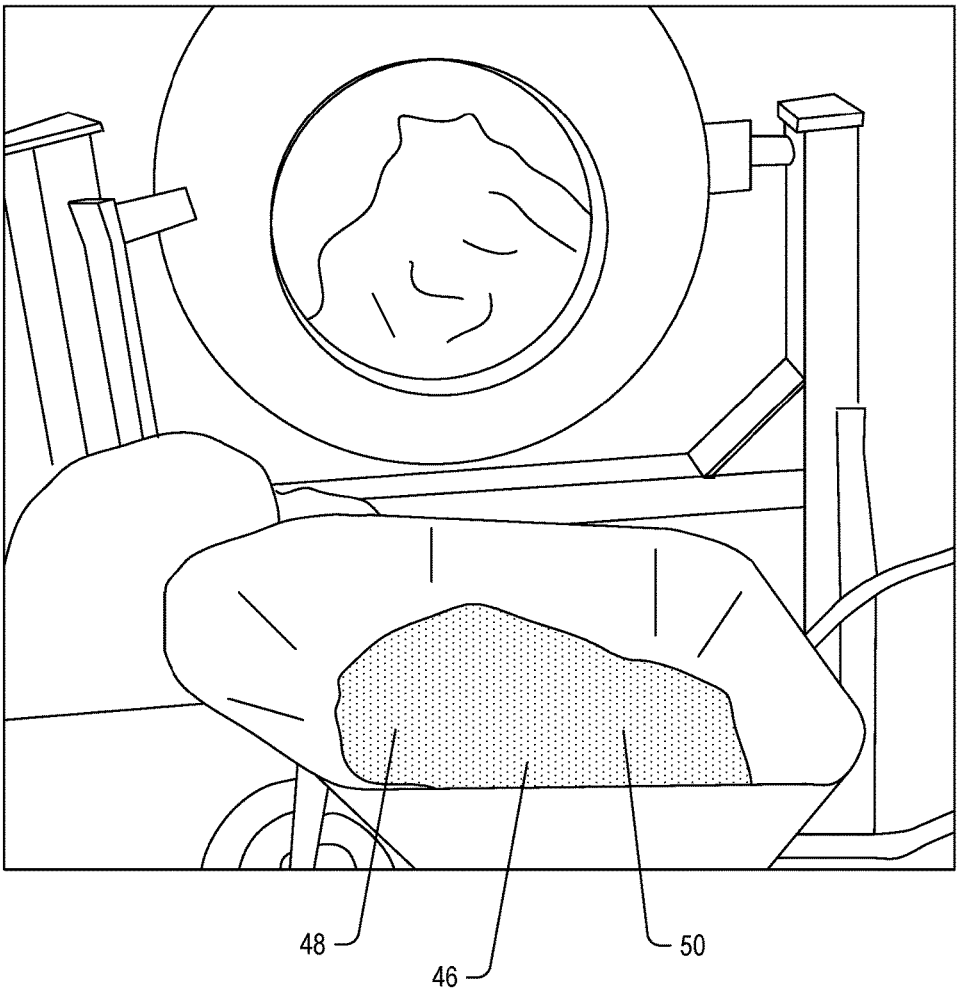

Once this is completed, a sand/rubber blend 46 is created (see FIG. 7). The sand/rubber blend 46 is composed of approximately 15% rubber particles 48 and 85% general purpose sand 50. As is appreciated, general purpose sand complies with ASTM C-144. With regard to the rubber particles 48, they are approximately 1/16 inch diameter particles, commonly referred to as crumb rubber and manufactured from old tires.

The sand/rubber blend 46 is then applied to the foam material 36 (see FIG. 8). Because of the open cell nature of the foam material 36, the sand/rubber blend 46 impregnates the foam material 36 and fills it in until the foam material 36 is fully saturated with the sand/rubber blend 46. This results in a 1/8 inch top layer of foam material 36 impregnated with the sand/rubber blend 46.

Figure 9:
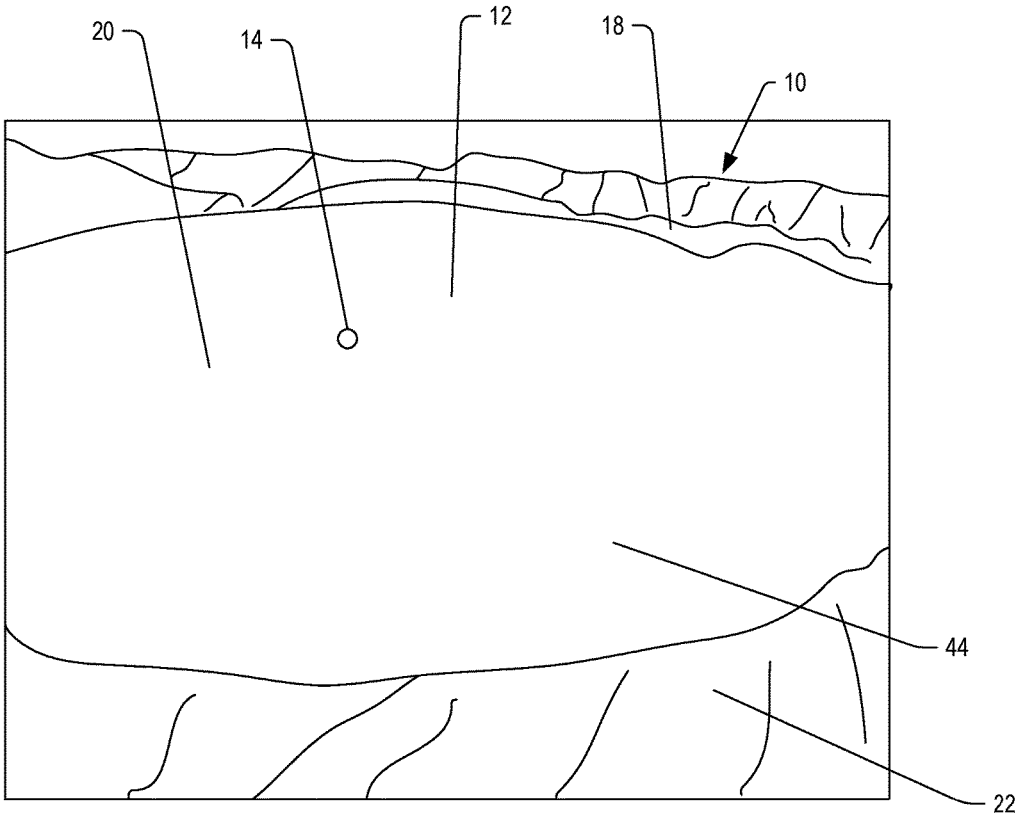
Figure 10:
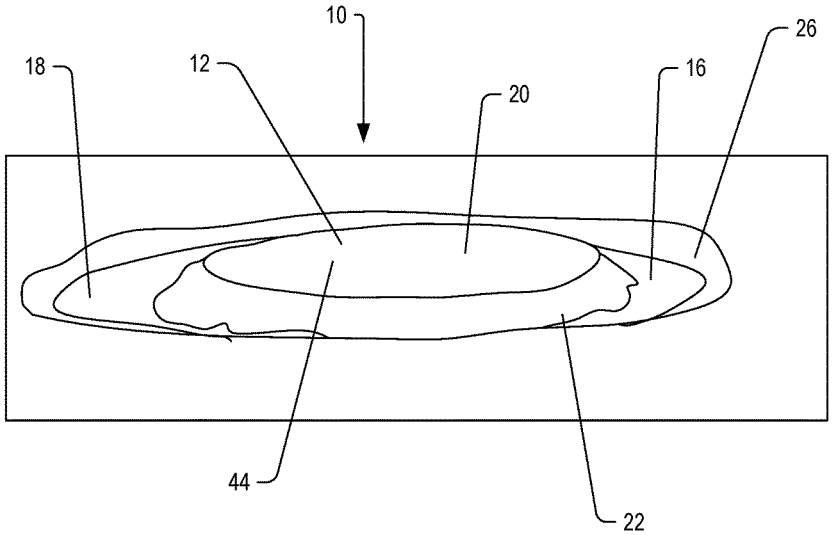

Thereafter, and with reference to FIGS. 9 and 10, a layer of synthetic turf 44 such as, SYNLawn®, SYNGreen 326, SYNGreen 200, SYNGreen 112 (manufactured by SYNLAWN Artificial Grass) or other similar, is applied over the crown 20 and along the downwardly sloping edges 22 thereof. Once the turf is in position and tamped down, the trough 18 is filled with sand 60 and the putting green 10 is ready for use.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A synthetic putting green including a crown, skirt and trough, comprising:

a support surface shaped to define a crown; a skirt circumferentially positioned about the crown; a trough circumferentially positioned about the skirt;

landscape edging applied to the support surface about a perimeter of the crown so as to define an interior space functioning as a putting surface; a containment layer applied upon the support surface within the interior space; an open cell foam material applied over the containment layer within the interior space, the open cell foam material impregnated with a sand/rubber blend;

a layer of synthetic turf applied to cover the containment layer and the open cell foam material within the interior space; and the open cell foam material with the sand/rubber blend is constrained on all sides by the containment layer underneath, by the landscape edging about a periphery of the open cell foam material, and by the layer of synthetic turf on top of the open cell foam material.

2. The synthetic putting green according to claim 1, wherein the trough includes an outer boundary.

3. The synthetic putting green according to claim 1, wherein the support surface includes an underlying support surface, a secondary support surface layer and a weed barrier cloth positioned between the underlying support surface and the secondary support surface layer.

4. The synthetic putting green according to claim 3, wherein the secondary support surface layer includes at least one of dirt, gravel, decomposed granite or clay.

5. The synthetic putting green according to claim 1, wherein a contact surface of the synthetic putting green is slightly raised from a base supporting structure so as to define a relatively planar top surface with the skirt downwardly tapering between the crown and the base supporting structure.

6. The synthetic putting green according to claim 1, wherein the containment layer is made from a nonwoven protective material.

7. The synthetic putting green according to claim 1, wherein the open cell foam material has a thickness between approximately 0.75 inch to approximately 1.25 inches.

8. The synthetic putting green according to claim 1, wherein the sand/rubber blend is composed of approximately 15% rubber particles and 85% general purpose sand.

9. A method for constructing a synthetic putting green including a crown, skirt and trough, comprising:

creating a support surface by grading a base supporting structure;

applying landscape edging on the support surface so as to define an interior space which is shaped and dimensioned as a putting surface on the crown of the putting green; filling the skirt and trough with fill dirt such that the fill dirt substantially surrounds the landscape edging and rises to a level even with an upper edge of the landscape edging; applying a containment layer to the support surface within the interior space; applying open cell foam material to an upper surface of the containment layer, the open cell foam material impregnated with a sand/rubber blend; and applying a layer of synthetic turf over the open cell foam material, the landscape edging, and the skirt constraining the open cell foam material in cooperation with the containment layer and the landscape edging.

10. The method for constructing a synthetic putting green according to claim 9, wherein the trough includes an outer boundary.

11. The method for constructing a synthetic putting green according to claim 9, wherein the support surface includes an underlying support surface, a secondary support surface layer and a weed barrier cloth positioned between the underlying support surface and the secondary support surface layer.

12. The method for constructing a synthetic putting green according to claim 11, wherein the secondary support surface layer is composed of dirt, gravel, decomposed granite or clay.

13. The method for constructing a synthetic putting green according to claim 9, wherein a contact surface of the synthetic putting green is slightly raised from the base supporting structure so as to define a relatively planar top surface with the skirt downwardly tapering between the crown and the base supporting structure.

14. The method for constructing a synthetic putting green according to claim 9, wherein the containment layer is made from a nonwoven protective material.

15. The method for constructing a synthetic putting green according to claim 9, wherein the open cell foam material has a thickness between approximately 0.75 inch to approximately 1.25 inches.

16. The method for constructing a synthetic putting green according to claim 9, wherein the sand/rubber blend is composed of approximately 15% rubber particles and 85% general purpose sand.

* * * * *